US010773134B1

(12) United States Patent
Frederickson

(10) Patent No.: US 10,773,134 B1
(45) **Date of Patent: *Sep. 15, 2020**

(54) GOLF CLUB HEAD WITH STRUCTURAL TENSION CABLE

(71) Applicant: Callaway Golf Company, Carlsbad, CA (US)

(72) Inventor: Austin L. Frederickson, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/711,297

(22) Filed: Dec. 11, 2019

Related U.S. Application Data

(63) Continuation of application No. 16/418,103, filed on May 21, 2019, now Pat. No. 10,512,826.

(51) Int. Cl.
*A63B 53/04* (2015.01)
*A63B 53/08* (2015.01)

(52) U.S. Cl.
CPC ..... *A63B 53/04* (2013.01); *A63B 53/08* (2013.01); *A63B 53/0412* (2020.08); *A63B 53/0433* (2020.08); *A63B 53/0454* (2020.08); *A63B 53/0462* (2020.08)

(58) Field of Classification Search
USPC ..... 473/324–350
See application file for complete search history.

(56) References Cited

U.S. PATENT DOCUMENTS 890,836 A * 6/1908 Beale ..... 473/329
4,055,941 A * 11/1977 Rivers, Jr. ..... A63B 51/02 57/248
4,168,606 A * 9/1979 Callander ..... A63B 51/02 57/236
4,285,898 A * 8/1981 Hoppe ..... D01D 5/088 264/211.14
4,288,977 A * 9/1981 Csaky ..... D01H 13/30 57/248
4,391,088 A * 7/1983 Salsky ..... A63B 51/02 273/DIG. 23
4,861,029 A * 8/1989 Takatsuka ..... A63B 49/00 473/540
5,316,304 A * 5/1994 Yost ..... A63B 53/0487 473/330

(Continued)

FOREIGN PATENT DOCUMENTS

JP 07313651 A * 12/1995

*Primary Examiner* — Alvin A Hunter
(74) *Attorney, Agent, or Firm* — Rebecca Hanovice; Michael Catania; Sonia Lari

(57) ABSTRACT

The disclosure is directed to a golf club head having an adjustable tension cable disposed proximate the face. The body has a face, a sole, and a return section, and defines a hollow interior. The cable extends between the return section and the sole within the hollow interior near the face to reduce stresses placed on the face during impact with a golf ball. The cable preferably forms a woven structure, with multiple connections between the return section and sole, and the tension in the cable is adjustable via a screw connected to one end of the cable that engages a threaded bore disposed near the hosel.

13 Claims, 5 Drawing Sheets

(56) References Cited

U.S. PATENT DOCUMENTS 5,364,103 A * 11/1994 Chen ..... A63B 67/002 473/219
5,505,453 A * 4/1996 Mack ..... A63B 53/04 473/329
5,772,529 A * 6/1998 Ruth, Jr. ..... A63B 53/04 473/327
5,899,819 A * 5/1999 Mount ..... A63B 53/0487 473/329
5,916,038 A * 6/1999 Uchiyama ..... A63B 53/00 473/290
5,954,594 A * 9/1999 Uchiyama ..... A63B 53/00 473/290
6,048,278 A * 4/2000 Meyer ..... A63B 53/04 473/345
6,257,999 B1 * 7/2001 Dahm ..... A63B 59/70 473/563
6,354,963 B1 * 3/2002 Kodama ..... A63B 53/04 473/345
6,517,450 B1 * 2/2003 Klyve ..... A63B 53/0487 473/340
6,524,197 B2 * 2/2003 Boone ..... A63B 53/0466 473/324
6,663,504 B2 * 12/2003 Hocknell ..... A63B 53/0466 473/329
6,682,439 B2 * 1/2004 Brown ..... A63B 53/02 473/329
7,871,335 B2 * 1/2011 Young ..... A63B 53/06 473/231
7,988,567 B2 * 8/2011 Kim ..... A63B 60/00 473/329
8,117,816 B2 * 2/2012 Yamamoto ..... D02G 3/444 57/204
8,702,530 B2 * 4/2014 Slaughter ..... A63B 53/00 473/297
9,005,753 B2 * 4/2015 Simmelink ..... D01D 5/04 428/364
9,194,059 B2 * 11/2015 Simmelink ..... B29C 48/05
9,700,764 B2 * 7/2017 Carter ..... A63B 53/0466
9,987,535 B2 * 6/2018 Kline ..... A63B 53/0466
10,369,435 B1 * 8/2019 Myers ..... A63B 60/00
10,512,826 B1 * 12/2019 Frederickson ..... A63B 60/42
2005/0054461 A1 * 3/2005 Pakarnseree ..... A63B 53/047 473/329
2005/0075193 A1 * 4/2005 Otoguro ..... A63B 53/0466 473/346
2009/0170628 A1 * 7/2009 Yoon ..... A63B 53/065 473/333

* cited by examiner

GOLF CLUB HEAD WITH STRUCTURAL TENSION CABLE

CROSS REFERENCES TO RELATED APPLICATIONS

The present application claims priority to and is a continuation of U.S. patent application Ser. No. 16/418,103, filed on May 21, 2019, and issued on Dec. 24, 2019, as U.S. Pat. No. 10,512,826, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head having a striking face and an adjustable, stress-reducing cable connecting an upper portion with a sole portion via a hollow interior proximate the striking face.

Description of the Related Art

The prior art discloses various golf club heads having interior structures. For example, Kosmatka, U.S. Pat. No. 6,299,547 for a Golf Club Head With an Internal Striking Plate Brace, discloses a golf club head with a brace to limit the deflection of the striking plate, Yabu, U.S. Pat. No. 6,852,038 for a Golf Club Head And Method of Making The Same, discloses a golf club head with a sound bar, Galloway, U.S. Pat. No. 7,118,493 for a Multiple Material Golf Club Head, discloses a golf club head with a composite aft body having an interior sound component extending upward from a sole section of a metal face component, Seluga et al., U.S. Pat. No. 8,834,294 for a Golf Club Head With Center Of Gravity Adjustability, discloses a golf club head with a tube having a mass for adjusting the CG of a golf club head, and Dawson et al., U.S. Pat. No. 8,900,070 for a Weighted Golf Club Head discloses a golf club head with an interior weight lip extending from the sole towards the face. However, the prior art fails to disclose an interior structure that increases ball speed through reducing stress in the striking face section at impact, with a minimal increase in mass to the golf club head.

BRIEF SUMMARY OF THE INVENTION

The golf club head of the present invention comprises at least one cable connecting a return or crown section to a sole section to stiffen and reduce the stress in a striking face section during impact with a golf ball. The cable, which is placed in tension between the return or crown section and sole section, is looped through rings attached to, or openings disposed in, the return or crown section and sole section. When fully engaged with the golf club head, the cables form a woven stress reduction structure disposed proximate the striking face section. The stress reduction structure is spaced within 0.500 inch of the rear surface of the striking face section, and no portion of the cables make contact with the rear surface, even during impact with a golf ball.

One aspect of the present invention is a golf club head comprising a body comprising a striking face, a sole section extending from a lower edge of the striking face, a return section extending from an upper edge of the striking face, a heel side, a toe side, and a hollow interior, an elongated cable comprising a first end and a second end, and a set screw, wherein the return section comprises at least one upper through-opening, wherein the sole section comprises at least one lower through-opening and a threaded screw bore, wherein the first end of the elongated cable is secured to a fixed location on an inner surface of the body within the hollow interior, wherein the cable extends through the at least one upper through-opening and the at least one lower through-opening to connect the return section to the sole section, wherein the second end of the elongated cable is secured to the set screw, wherein the set screw is disposed within and engages with the threaded screw bore, and wherein adjusting the location of the set screw within the threaded screw bore changes the tension of the elongated cable within the body and a stiffness of the striking face. In some embodiments, the at least one upper through-opening may be supported by at least one upper boss, which may extend into the hollow interior from the return section, and the at least one lower through-opening may be supported by at least one lower boss, which may extend into the hollow interior from the sole section.

In other embodiments, the golf club head may further comprise a hosel and a heel side tube aligned with the hosel, and the threaded screw bore may extend from and be in communication with the heel side tube. In a further embodiment, the threaded screw bore may extend from the heel side towards the toe side approximately parallel with the striking face. In other embodiments, the fixed location may be on the toe side of the body, and in a further embodiment, the fixed location may be on the return section. In other embodiments, the elongated cable may be composed of a material selected from the group consisting of aramid, liquid crystal polymer, and ultra-high-molecular-weight polyethylene. In yet another embodiment, the return section may comprise six pairs of upper through-openings, and the sole section may comprise six pairs of lower through-openings. In a further embodiment, each pair of the upper and lower through-openings may be supported by a boss extending into the hollow interior from one of the sole section and return section. In any of these embodiments, the second end of the elongated cable may be secured to the set screw with a cable crimp.

Another aspect of the present invention is a golf club head comprising a body comprising a striking face, a crown, a sole, a hosel, and a hollow interior, and a volume of at least 300 cubic centimeters, and a woven support structure connecting the crown to the sole, wherein the woven support structure comprises an elongated cable looped through a plurality of openings in the crown and the sole, wherein the woven support system is at least partially contained within the hollow interior and is disposed proximate the striking face, and wherein the tension of the elongated cable within the body is adjustable. In some embodiments, the elongated cable may extend from the crown to the sole at least twice. In other embodiments, the woven support structure may comprise at least four loops of cable. In still other embodiments, the body may be composed of a metal alloy, and the elongated cable may be composed of a non-metal material, which may be selected from the group consisting of aramid, liquid crystal polymer, and ultra-high-molecular-weight polyethylene. In yet another embodiment adjusting the tension of the elongated cable within the body may change the stiffness of at least a portion of the striking face, and in particular a boundary of the striking face. In any of these embodiments, no portion of the elongated cable may be in compression.

Yet another aspect of the present invention is a golf club head comprising a metal alloy body comprising a striking face, a sole section extending from a lower edge of the striking face, a return section extending from an upper edge of the striking face, a heel side, a toe side, a hosel, a heel side tube aligned with the hosel, a hollow interior, and an upper opening, a composite crown section sized to cover the upper opening, an elongated cable comprising a first end and a second end, and a set screw, wherein the return section comprises at least one upper through-opening, wherein the sole section comprises at least one lower through-opening and a threaded screw bore, wherein the threaded screw bore extends from and is in communication with the heel side tube, wherein the first end of the elongated cable is secured to a fixed location on an inner surface of the body within the hollow interior, wherein the cable extends through the at least one upper through-opening and the at least one lower through-opening to connect the return section to the sole section, wherein the elongated cable extends between the return section to the sole section at least twice, wherein the second end of the elongated cable is secured to the set screw, wherein the set screw is disposed within and engages with the threaded screw bore, wherein the elongated cable is composed of a non-metal material selected from the group consisting of aramid, liquid crystal polymer, and ultra-high-molecular-weight polyethylene, and wherein adjusting the location of the set screw within the threaded screw bore changes the tension of the elongated cable within the body and a stiffness of the striking face. In some embodiments, the second end of the elongated cable may be secured to the set screw with at least one of an adhesive and a mechanical connector.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
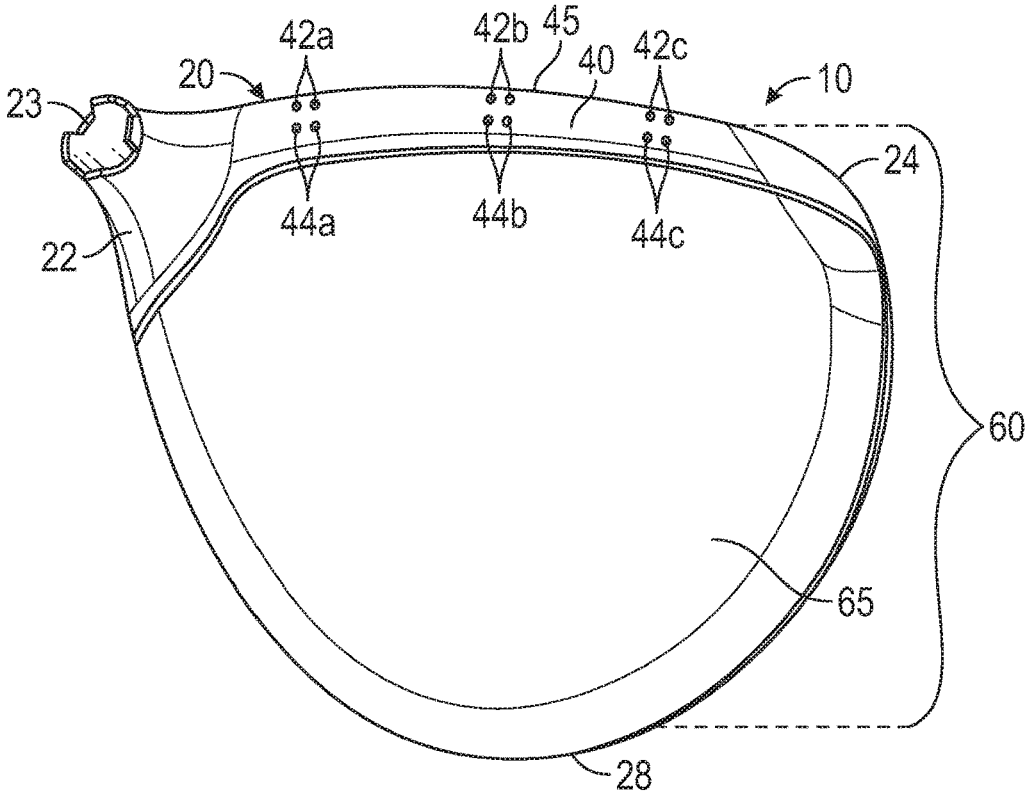
FIG. 1 is a top elevational view of the preferred embodiment of the golf club head of the present invention.

A preferred embodiment of the golf club head 10 of the present invention is shown in FIGS. 1-9. The golf club head 10 includes a body 20 having a striking face section 30 with a geometric face center 32 and a rear surface 34, a return section 40 extending away from an upper edge 31 of the striking face section 30 toward an aft end 28, a sole section 50 extending away from a lower edge 33 of the striking face section 30 to the aft end 28, a hosel 23 for engaging a shaft, a heel end 22, a toe end 24, an upper opening 26, and a hollow interior 27. A crown section 60 is comprised of the return section 32 and a crown insert 65 that is placed over the upper opening 26 and affixed to the body 20 to enclose the hollow interior 27.

As shown in the Figures, the return section 40 includes six pairs of through openings 42*a*, 44*a*, 42*b*, 44*b*, 42*c*, 44*c*: two pairs of through openings 42*a*, 44*a* disposed at the heel end 22, two pairs of through openings 42*b*, 44*b* disposed at a center area 45 between the heel and toe ends 22, 24 and approximately aligned with a center of the striking face section 30, and two pairs of through openings 42*c*, 44*c* disposed at the toe end 24 that are in communication with the hollow interior 27 of the body 20. Three bosses 46*a*, 46*b*, 46*c* extend into the hollow interior 27 and support the through openings 42, 44. One boss 46*a* is disposed at the heel end 22, one boss 46*b* at the center, and one boss 46*c* at the toe end 24. The sole section 50 includes another six pairs of through openings 52*a*, 54*a*, 52*b*, 54*b*, 52*c*, 54*c* and three bosses 56*a*, 56*b*, 56*c* supporting those through-openings 52, 54. One set of through-openings 52*a*, 54*a* and one boss 56*a* are disposed at the heel end 22, one set of through-openings 52*b*, 54*b* and one boss 56*b* are disposed at a center area 55 of the sole 50, and the final set of through openings 52*c*, 54*c* and boss 56*c* are disposed at the toe end 24. A single set of through-openings 58, are disposed slightly rearward of the other through-openings 52, 54 and are supported by a third boss 56*d*.

The body 20 comprises a heel side tube 25 disposed beneath the hosel 23 through which a mechanical fastener (not shown) can be affixed to a shaft sleeve (not shown), and a screw bore 70 supported by a wall 75 that intersects with the heel side tube 25 extends from the heel end 22 of the body 20 towards the toe end 24 approximately parallel with the striking face section 30. The screw bore 70 comprises threads 72 that are sized to engage with external threads 81 on a set screw 80.

Figure 2:
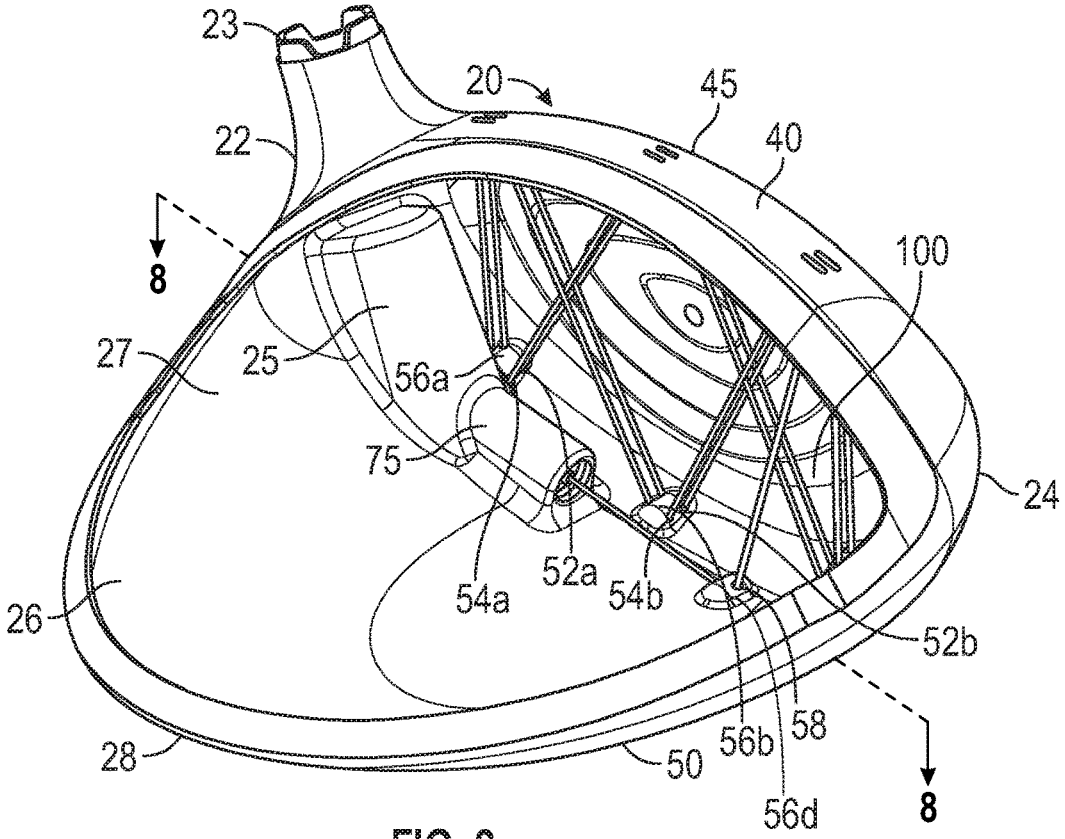
FIG. 2 is a top perspective view of the golf club head shown in FIG. 1 without its crown.
Figure 3:
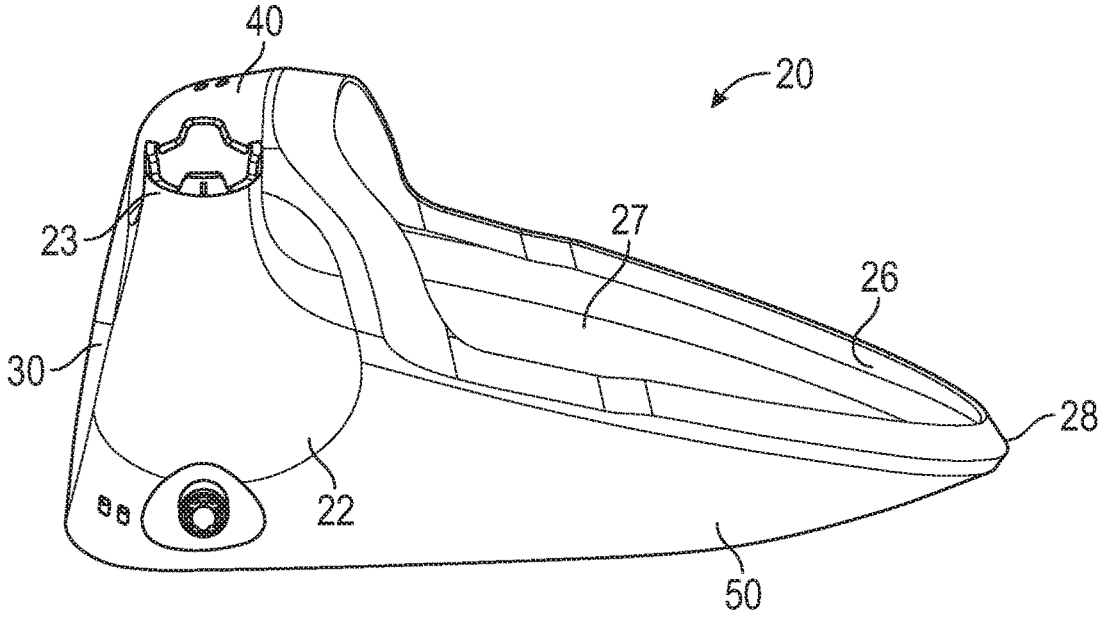
FIG. 3 is a side perspective view of the golf club head shown in FIG. 2.
Figure 4:
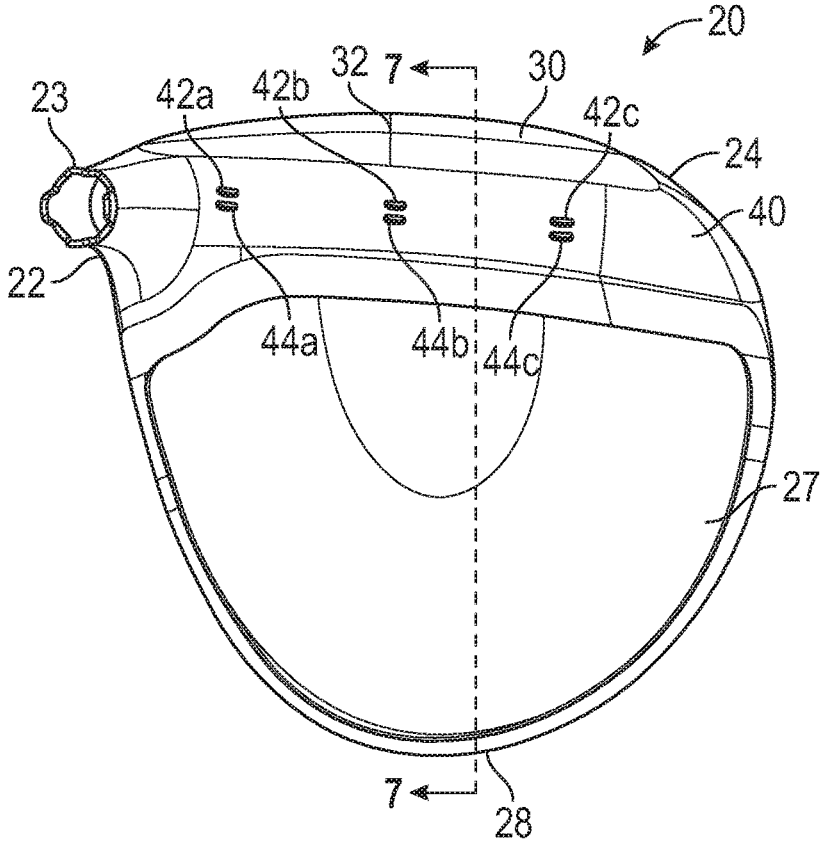
FIG. 4 is a top elevational view of the golf club head shown in FIG. 2.
Figure 5:
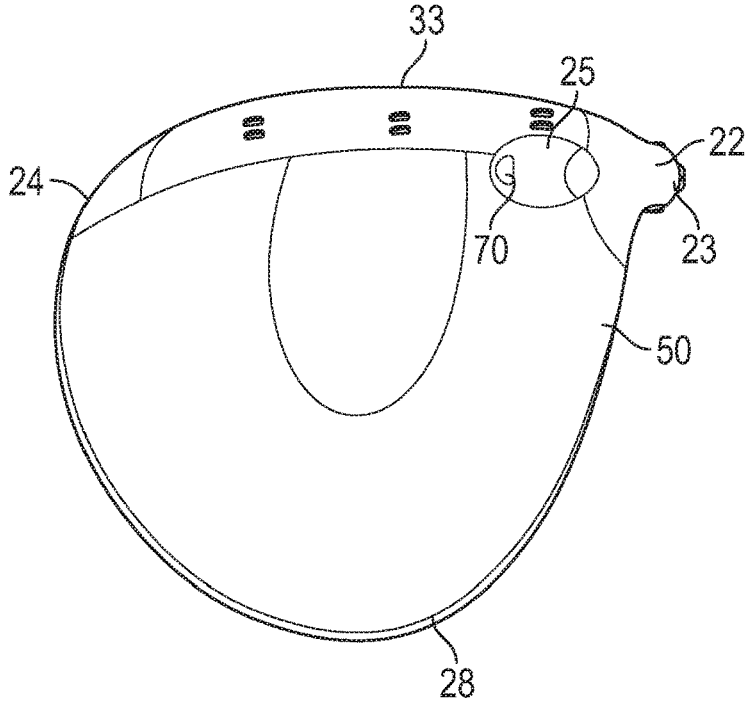
FIG. 5 is a bottom perspective view of the golf club head shown in FIG. 2.
Figure 6:
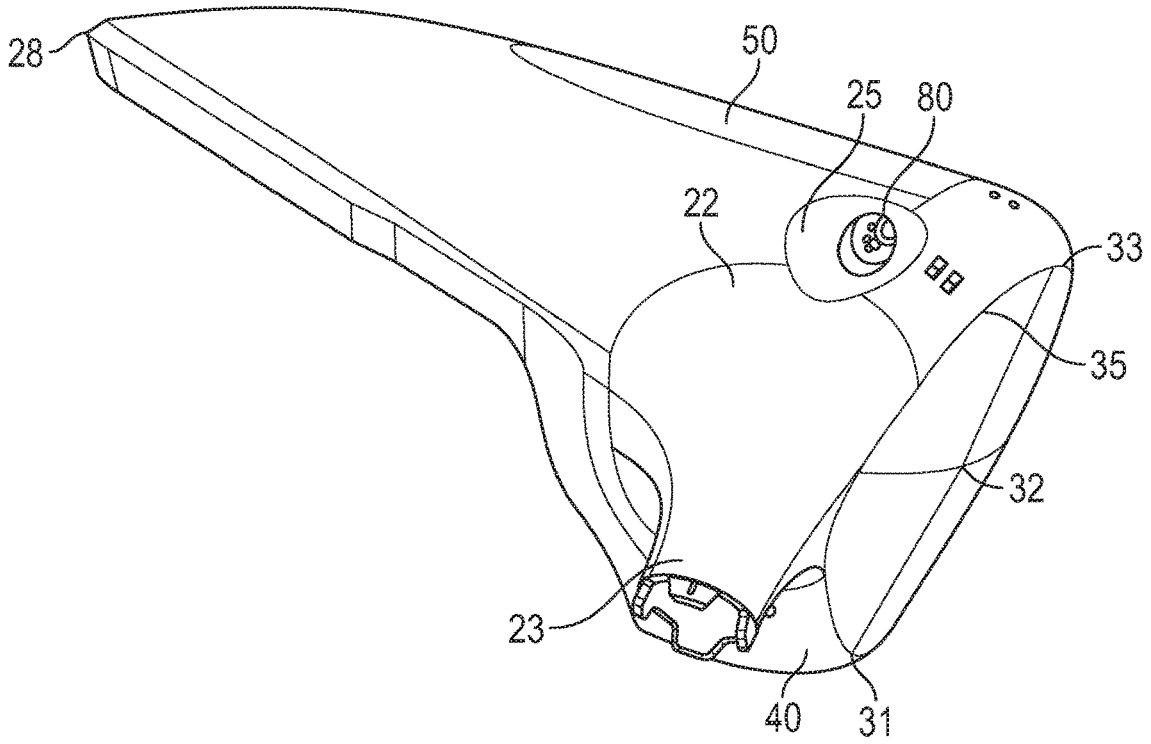
FIG. 6 is a heel side perspective view of the golf club head shown in FIG. 2.
Figure 7:
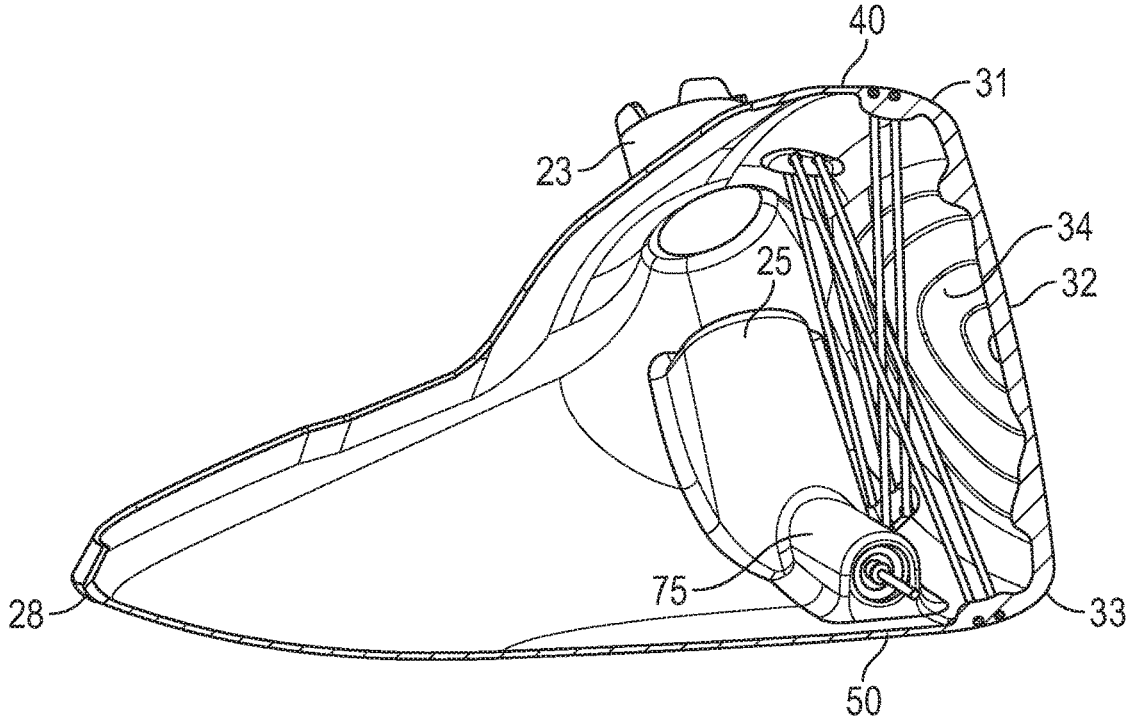
FIG. 7 is a cross-sectional view of the golf club head shown in FIG. 4 along lines 7-7.
Figure 8:
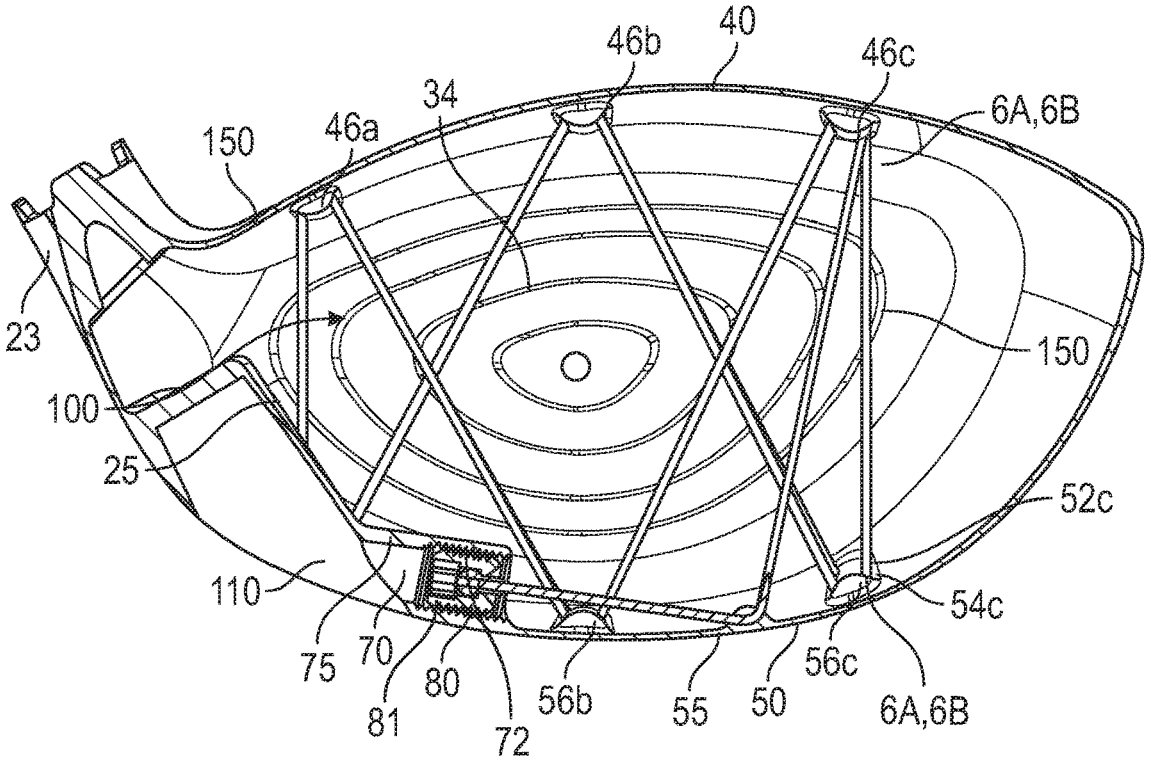
FIG. 8 is a cross-sectional view of the golf club head shown in FIG. 2 along lines 5-5.

A first end 102 of the cable 100 is attached to a fixed point within the body 20, in the preferred embodiment at the toe end 24 of the return section 40 of the body 20, and then the second end 104 of the cable 100 is threaded through each of the openings 42, 44, 52, 54 to create a woven support structure 150. The woven support structure 150 preferably comprises at least two loops of cable 100 extending between the return section 40 and the sole section 50, and more preferably (as shown in FIGS. 2, 7, and 8) twelve loops. It is important is that the connectors of the woven support structure 150 connect the return section 40 to the sole section 50 proximate the striking face section 30, without making contact with any portion of the striking face section 30, even when the striking face section 30 impacts a golf ball. This proximity is critical for optimizing the normalized ball speed relationship to characteristic time (CT), as measured in μs by the U.S. Golf Association (USGA) CT test Once the cable 100 has been woven through the openings 42, 44, 52, 54 to connect the return and sole sections 40, 50, the cable 100 is cut to the desired length and the second end 104 of the cable 100 is secured to the set screw 80 with an adhesive and/or a mechanic connection. In the preferred embodiment, the second end is threaded through an end opening 82 in the set screw 80 and a cable crimp 110 or ball joint connector (such as the one disclosed in U.S. patent application Ser. No. 15/960,316, the disclosure of which is hereby incorporated by reference in its entirety herein) is attached to the second end 104 to secure the cable 100 to the set screw 80.

The set screw 80 is disposed within the screw bore 70, and changing the location of the set screw 80 within the screw bore 70 affects the tension, or pre-load, of the cable 100. For example, moving the set screw 80 heel-wards towards the heel side tube 25 tightens the cable 100 within the body 20, while moving the set screw toe-wards away from the heel side tube 25 loosens the cable 100 within the body 20. Tightening the cable 100 stiffens the face boundary 35, while loosening the set screw 80 relaxes the face boundary 35, and allows the user to adjust the stiffness of the striking face 30 to optimize its performance and, in particular, the normalized ball speed relationship to CT.

Figure 9A:
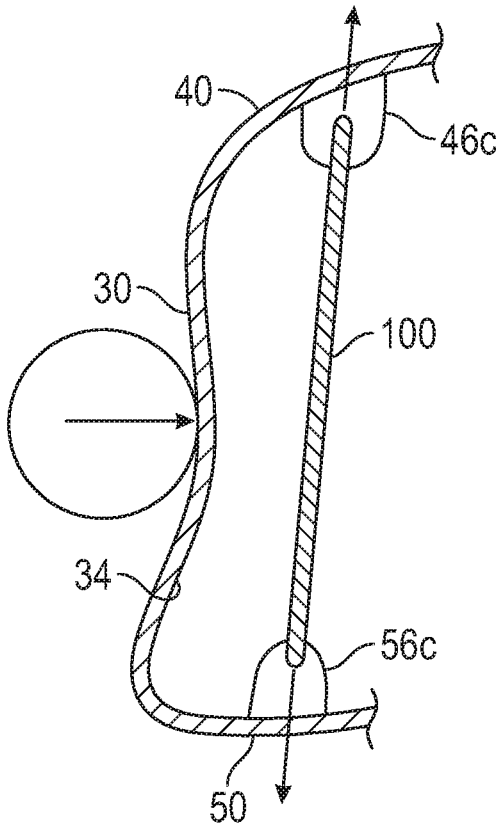
FIG. 9A is a cross sectional view of the golf club head shown in FIG. 5 with the cable in tension.
Figure 9B:
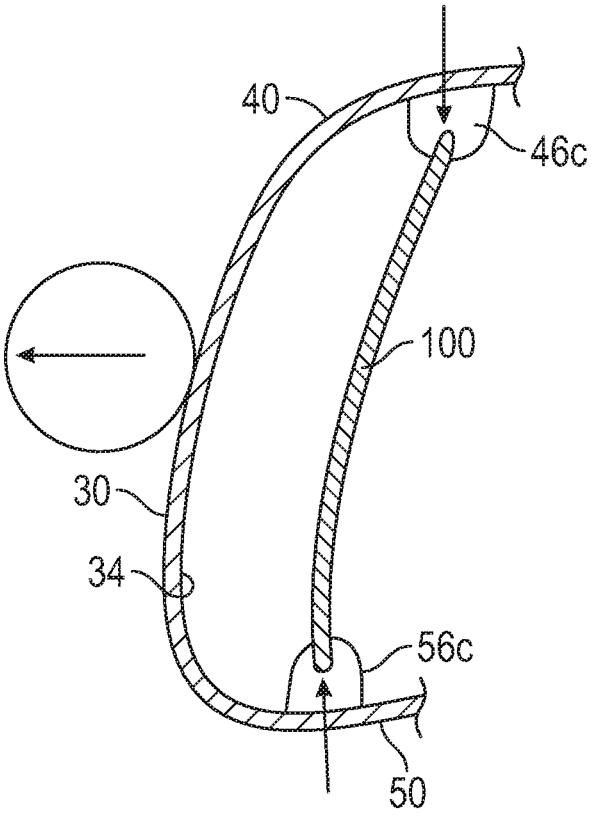
FIG. 9B is a cross sectional view of the golf club head shown in FIG. 5 with the cable in compression.

The cable 100 is composed of a lightweight, high strength material such as aramid, liquid crystal polymer (LCP), or ultra-high-molecular-weight polyethylene (UHMWPE), which lowers the overall weight of the assembly. The cable 100 cannot carry compression, which allows the striking face 30 to rebound unrestricted, as shown in FIGS. 9A and 9B From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf club head comprising:

a metal body comprising a striking face, a sole section extending from a lower edge of the striking face, a return section extending from an upper edge of the striking face, a heel side, a toe side, and a hollow interior;

an elongated cable comprising a first end and a second end; and a set screw, wherein the elongated cable is composed of ultra-high-molecular-weight polyethylene, wherein the return section comprises at least one upper through-opening supported by at least one upper boss that extends into the hollow interior from the return section, wherein the sole section comprises at least one lower through-opening supported by at least one lower boss that extends into the hollow interior from the sole section and a threaded screw bore, wherein the first end of the elongated cable is secured to a fixed location on an inner surface of the body within the hollow interior, wherein the cable extends through the at least one upper through-opening and the at least one lower through-opening to connect the return section to the sole section, wherein the second end of the elongated cable is secured to the set screw, wherein the set screw is disposed within and engages with the threaded screw bore, and wherein adjusting the location of the set screw within the threaded screw bore changes the tension of the elongated cable within the body and a stiffness of the striking face.

2. The golf club head of claim 1, wherein the fixed location is on the toe side of the body.

3. The golf club head of claim 2, wherein the fixed location is on the return section.

4. The golf club head of claim 1, wherein the return section comprises six pairs of upper through-openings, and wherein the sole section comprises six pairs of lower through-openings.

5. The golf club head of claim 4, wherein each pair of the upper and lower through-openings is supported by a boss extending into the hollow interior from one of the sole section and return section.

6. The golf club head of claim 1, wherein the second end of the elongated cable is secured to the set screw with a cable crimp.

7. The golf club head of claim 1, wherein the elongated cable extends from the crown to the sole at least twice.

8. The golf club head of claim 1, wherein adjusting the tension of the elongated cable within the body changes the stiffness of a boundary of the striking face.

9. The golf club head of claim 1, wherein no portion of the elongated cable is in compression.

10. A golf club head comprising:

a metal body comprising a striking face, a sole section extending from a lower edge of the striking face, a return section extending from an upper edge of the striking face, a heel side, a toe side, a hollow interior, a hosel, and a heel side tube aligned with the hosel, an elongated cable comprising a first end and a second end; and a set screw, wherein the elongated cable is composed of ultra-high-molecular-weight polyethylene, wherein the return section comprises at least one upper through-opening, wherein the sole section comprises at least one lower through-opening and a threaded screw bore that extends from and is in communication with the heel side tube, wherein the first end of the elongated cable is secured to a fixed location on an inner surface of the body within the hollow interior, wherein the cable extends through the at least one upper through-opening and the at least one lower through-opening to connect the return section to the sole section, wherein the second end of the elongated cable is secured to the set screw, and wherein the set screw is disposed within and engages with the threaded screw bore.

11. The golf club head of claim 10, wherein the threaded screw bore extends from the heel side towards the toe side approximately parallel with the striking face.

12. A golf club head comprising:

a metal alloy body comprising a striking face, a sole section extending from a lower edge of the striking face, a return section extending from an upper edge of the striking face, a heel side, a toe side, a hosel, a heel side tube aligned with the hosel, a hollow interior, and an upper opening;

a composite crown section sized to cover the upper opening;

an elongated cable comprising a first end and a second end; and a set screw, wherein the return section comprises at least one upper through-opening, wherein the sole section comprises at least one lower through-opening and a threaded screw bore, wherein the threaded screw bore extends from and is in communication with the heel side tube, wherein the first end of the elongated cable is secured to a fixed location on an inner surface of the body within the hollow interior, wherein the cable extends through the at least one upper through-opening and the at least one lower through-opening to connect the return section to the sole section, wherein the elongated cable extends between the return section to the sole section at least twice, wherein the second end of the elongated cable is secured to the set screw, wherein the set screw is disposed within and engages with the threaded screw bore, wherein the elongated cable is composed of a liquid crystal polymer, and wherein adjusting the location of the set screw within the threaded screw bore changes the tension of the elongated cable within the body and a stiffness of the striking face.

13. The golf club head of claim 12, wherein the second end of the elongated cable is secured to the set screw with at least one of an adhesive and a mechanical connector.

* * * * *